US009234406B2

(12) United States Patent
Naedler et al.

(10) Patent No.: US 9,234,406 B2
(45) Date of Patent: Jan. 12, 2016

(54) SEAT ASSEMBLY WITH COUNTER FOR ISOLATING FRACTURE ZONES IN A WELL

(71) Applicant: UTEX Industries, Inc., Houston, TX (US)

(72) Inventors: Mark Henry Naedler, Cypress, TX (US); Derek L. Carter, Houston, TX (US)

(73) Assignee: UTEX Industries, Inc., Houston, TX (US)

( * ) Notice: Subject to any disclaimer, the term of this patent is extended or adjusted under 35 U.S.C. 154(b) by 0 days.

(21) Appl. No.: 14/666,977

(22) Filed: Mar. 24, 2015

(65) Prior Publication Data

US 2015/0191998 A1 Jul. 9, 2015

Related U.S. Application Data

(63) Continuation of application No. 13/887,779, filed on May 6, 2013.

(60) Provisional application No. 61/644,887, filed on May 9, 2012.

(51) Int. Cl.

| | |
|---|---|
| ***E21B 34/14*** | (2006.01) |
| ***E21B 43/14*** | (2006.01) |
| *E21B 34/00* | (2006.01) |

(52) U.S. Cl.

CPC ..... *E21B 34/14* (2013.01); *E21B 43/14* (2013.01); *E21B 2034/007* (2013.01)

(58) Field of Classification Search

CPC ..... E21B 34/14

See application file for complete search history.

(56) References Cited

U.S. PATENT DOCUMENTS

| | | | |
|---|---|---|---|
| 2,947,363 | A | 8/1960 | Sackett et al. |
| 2,973,006 | A | 2/1961 | Nelson |

(Continued)

FOREIGN PATENT DOCUMENTS

| | | |
|---|---|---|
| EP | 2791458 | 10/2014 |
| JP | 2006314708 | 11/2006 |

(Continued)

OTHER PUBLICATIONS

Dictionary definition of "stretched", accessed May 28, 2015 via thefreedictionary.com.*

(Continued)

*Primary Examiner* — Blake Michener

(74) *Attorney, Agent, or Firm* — Haynes and Boone, LLP

(57) ABSTRACT

A specially designed rotary indexing system and associated operational methods are incorporated in a downhole control device, representatively a sliding sleeve valve, having an outer tubular member in which an annular plug seat is coaxially disposed. The plug seat is resiliently expandable between a first diameter and a larger second diameter and is illustratively of a circumferentially segmented construction. The rotary indexing system is operative to detect the number of plug members that pass through and diametrically expand the plug seat, and responsively preclude passage of further plug members therethrough when such number reaches a predetermined magnitude. Such predetermined magnitude is correlated to the total rotation of an indexing system counter ring portion rotationally driven by axial camming forces transmitted to the rotary indexing system by successive plug member passage-generated diametrical expansions of the plug seat.

16 Claims, 12 Drawing Sheets

(56) References Cited

U.S. PATENT DOCUMENTS

| | | | | |
|---|---|---|---|---|
| 3,054,415 | A | 9/1962 | Baker | |
| 3,441,279 | A | 4/1969 | Lally et al. | |
| 3,554,281 | A | 1/1971 | Ecuer | |
| 3,568,768 | A | 3/1971 | Rowell, Jr. | |
| 3,667,505 | A | 6/1972 | Radig | |
| 3,885,627 | A | 5/1975 | Berry et al. | |
| 4,044,835 | A | 8/1977 | Mott | |
| 4,189,150 | A | 2/1980 | Langieri | |
| 4,252,196 | A | 2/1981 | Siberman et al. | |
| 4,292,988 | A | 10/1981 | Montgomery | |
| 4,448,216 | A | 5/1984 | Speegle et al. | |
| 4,510,994 | A | 4/1985 | Pringle | |
| 4,520,870 | A | 6/1985 | Pringle | |
| 4,537,383 | A | 8/1985 | Fredd | |
| 4,583,593 | A | 4/1986 | Zunkel et al. | |
| 4,828,037 | A | 5/1989 | Lindsey et al. | |
| 5,146,992 | A | 9/1992 | Baugh | |
| 5,226,539 | A | 7/1993 | Cheng | |
| 5,244,044 | A | 9/1993 | Henderson | |
| 5,297,580 | A | 3/1994 | Thurman | |
| 5,813,483 | A | 9/1998 | Latham et al. | |
| 5,960,881 | A | 10/1999 | Allamon et al. | |
| 6,003,607 | A | 12/1999 | Hagen et al. | |
| 6,032,734 | A | 3/2000 | Telfer | |
| 6,053,246 | A | 4/2000 | Echols et al. | |
| 6,053,250 | A | 4/2000 | Echols | |
| 6,155,350 | A | 12/2000 | Melenyzer | |
| 6,227,298 | B1 | 5/2001 | Patel | |
| 6,230,807 | B1 | 5/2001 | Patel | |
| 6,390,200 | B1 | 5/2002 | Allamon et al. | |
| 6,662,877 | B2 | 12/2003 | Patel | |
| 6,681,860 | B1 | 1/2004 | Yokley et al. | |
| 6,695,066 | B2 | 2/2004 | Allamon et al. | |
| 6,725,935 | B2 | 4/2004 | Szarka et al. | |
| 6,769,490 | B2 | 8/2004 | Allamon et al. | |
| 6,799,638 | B2 | 10/2004 | Butterfield, Jr. | |
| 6,866,100 | B2 | 3/2005 | Gudmestad et al. | |
| 6,966,368 | B2 | 11/2005 | Farquhar | |
| 7,021,389 | B2 * | 4/2006 | Bishop et al. | 166/373 |
| 7,503,392 | B2 | 3/2009 | King et al. | |
| 7,637,323 | B2 | 12/2009 | Schasteen et al. | |
| 7,644,772 | B2 | 1/2010 | Avant et al. | |
| 7,673,677 | B2 | 3/2010 | King et al. | |
| 7,921,922 | B2 | 4/2011 | Darnell et al. | |
| 8,151,891 | B1 | 4/2012 | Darnell et al. | |
| 8,261,761 | B2 | 9/2012 | Gerrard et al. | |
| 8,276,675 | B2 | 10/2012 | Williamson et al. | |
| 8,403,068 | B2 * | 3/2013 | Robison et al. | 166/386 |
| 8,479,808 | B2 | 7/2013 | Gouthaman | |
| 8,479,823 | B2 * | 7/2013 | Mireles | 166/332.2 |
| 8,668,006 | B2 | 3/2014 | Xu | |
| 8,950,496 | B2 * | 2/2015 | Kitzman | 166/318 |
| 9,004,179 | B2 * | 4/2015 | Chauffe | 166/373 |
| 2002/0043368 | A1 | 4/2002 | Bell et al. | |
| 2005/0072572 | A1 * | 4/2005 | Churchill | 166/319 |
| 2006/0213670 | A1 | 9/2006 | Bishop et al. | |
| 2006/0243455 | A1 * | 11/2006 | Telfer et al. | 166/386 |
| 2007/0017679 | A1 | 1/2007 | Wolf et al. | |
| 2007/0181188 | A1 | 8/2007 | Branch et al. | |
| 2008/0093080 | A1 | 4/2008 | Palmer et al. | |
| 2008/0217025 | A1 | 9/2008 | Ruddock et al. | |
| 2009/0044946 | A1 | 2/2009 | Schasteen et al. | |
| 2009/0044949 | A1 | 2/2009 | King et al. | |
| 2009/0044955 | A1 | 2/2009 | King et al. | |
| 2009/0308588 | A1 | 12/2009 | Howell et al. | |
| 2010/0132954 | A1 * | 6/2010 | Telfer | 166/373 |
| 2010/0212911 | A1 | 8/2010 | Chen et al. | |
| 2010/0282338 | A1 * | 11/2010 | Gerrard et al. | 137/330 |
| 2011/0067888 | A1 * | 3/2011 | Mireles | 166/386 |
| 2011/0108284 | A1 | 5/2011 | Flores et al. | |
| 2011/0180270 | A1 | 7/2011 | Martin et al. | |
| 2011/0192613 | A1 | 8/2011 | Garcia et al. | |
| 2011/0278017 | A1 * | 11/2011 | Themig et al. | 166/373 |
| 2011/0315389 | A1 * | 12/2011 | Crider et al. | 166/329 |
| 2011/0315390 | A1 * | 12/2011 | Guillory et al. | 166/329 |
| 2012/0048556 | A1 | 3/2012 | O'Connell et al. | |
| 2012/0097265 | A1 * | 4/2012 | Gerrard et al. | 137/330 |
| 2012/0227973 | A1 * | 9/2012 | Hart et al. | 166/329 |
| 2012/0261131 | A1 * | 10/2012 | Hofman et al. | 166/316 |
| 2012/0305236 | A1 | 12/2012 | Gouthaman | |
| 2012/0305265 | A1 | 12/2012 | Garcia et al. | |
| 2013/0025868 | A1 | 1/2013 | Smith et al. | |
| 2013/0118732 | A1 * | 5/2013 | Chauffe et al. | 166/250.04 |
| 2013/0133876 | A1 | 5/2013 | Naedler et al. | |
| 2013/0153220 | A1 | 6/2013 | Carter et al. | |
| 2013/0186633 | A1 * | 7/2013 | Kitzman | 166/318 |
| 2013/0186644 | A1 * | 7/2013 | Smith et al. | 166/381 |
| 2014/0060813 | A1 | 3/2014 | Naedler et al. | |
| 2015/0176361 | A1 | 6/2015 | Prosser et al. | |

FOREIGN PATENT DOCUMENTS

| | | | |
|---|---|---|---|
| WO | WO 00/63526 | A1 | 10/2000 |
| WO | WO 2009/067485 | A2 | 5/2009 |

OTHER PUBLICATIONS

PCT Search Report with Written Opinion, Application No. PCT/US2013/039964, Sep. 4, 2013, 14 pgs.

Supplementary European Search Report and Annex to the European Search Report issued for EP13787954, dated Sep. 17, 2015, 6 pgs.

* cited by examiner

SEAT ASSEMBLY WITH COUNTER FOR ISOLATING FRACTURE ZONES IN A WELL

CROSS-REFERENCE TO RELATED APPLICATION

This application is a Continuation of U.S. patent application Ser. No. 13/887,779, filed May 6, 2013, which claims priority to Provisional Patent Application No. 61/644,887, filed May 9, 2012, the disclosure of which is incorporated herein by reference.

FIELD OF THE INVENTION

The present invention relates to a fracture plug seat assembly used in well stimulation for engaging and creating a seal when a plug, such as a ball, is dropped into a wellbore and landed on the fracture plug seat assembly for isolating fracture zones in a well. More particularly, the present invention relates to a fracture plug seat assembly that includes a mechanical counter allowing plugs to pass through the seat then locking to a rigid seat position after a designated number of plugs from the surface have passed through the seat. The locking mechanism disengages when flow is reversed and plugs are purged.

BACKGROUND

In well stimulation, the ability to perforate multiple zones in a single well and then fracture each zone independently, referred to as "zone fracturing", has increased access to potential reserves. Zone fracturing helps stimulate the well by creating conduits from the formation for the hydrocarbons to reach the well. Many gas wells are drilled for zone fracturing with a system called a ball drop system planned at the well's inception. A well with a ball drop system will be equipped with a string of piping below the cemented casing portion of the well. The string is segmented with packing elements, fracture plugs and fracture plug seat assemblies to isolate zones. A fracture plug, such as a ball or other suitably shaped structure (hereinafter referred to collectively as a "ball") is dropped or pumped down the well and seats on the fracture plug seat assembly, thereby isolating pressure from above.

Typically, in ball drop systems a fracture plug seat assembly includes a fracture plug seat having an axial opening of a select diameter. To the extent multiple fracture plugs are disposed along a string, the diameter of the axial opening of the respective fracture plug seats becomes progressively smaller with the depth of the string. This permits a plurality of balls having a progressively increasing diameter, to be dropped (or pumped), smallest to largest diameter, down the well to isolate the various zones, starting from the toe of the well and moving up.

A large orifice through an open seat is desired while fracing zones below that seat. An unwanted consequence of having seats incrementally smaller as they approach the toe is the existence of pressure loss across the smaller seats. The pressure loss reduces the efficiency of the system and creates flow restrictions while fracing and during well production.

In order to maximize the number of zones and therefore the efficiency of the well, the difference in the diameter of the axial opening of adjacent fracture plug seats and the diameter of the balls designed to be caught by such fracture plug seats is very small, and the consequent surface area of contact between the ball and its seat is very small. Due to the high pressure that impacts the balls during a hydraulic fracturing process, the balls often become stuck and are difficult to purge when fracing is complete and the well pressure reverses the flow and produces to the surface. If a ball is stuck in the seat and cannot be purged, the ball(s) must be removed from the string by costly and time-consuming milling or drilling processes.

FIG. 1 illustrates a prior art fracture plug seat assembly 10 disposed along a tubing string 12. Fracture plug seat assembly 10 includes a metallic, high strength composite or other rigid material seat 14 mounted on a sliding sleeve 16 which is movable between a first position and a second position. In the first position shown in FIG. 1, sleeve 16 is disposed to inhibit fluid flow through radial ports 18 from annulus 20 into the interior of tubing string 12. Packing element 24 is disposed along tubing string 12 to restrict fluid flow in the annulus 20 formed between the earth 26 and the tubing string 12.

FIG. 2 illustrates the prior art fracture plug seat assembly 10 of FIG. 1, but with a ball 28 landed on the metallic, high strength composite or other rigid material seat 14 and with sliding sleeve 16 in the second position. With ball 28 landed on the metallic, high strength composite or other rigid material seat 14, fluid pressure 30 applied from uphole of fracture plug seat assembly 10 urges sliding sleeve 16 into the second position shown in FIG. 2, thereby exposing radial ports 18 to permit fluid flow therethrough, diverting the flow to the annulus 20 formed between the earth 26 and the tubing string 12.

As shown in FIGS. 1 and 2, the metallic, high strength composite or other rigid material seat 14 has a tapered surface 32 that forms an inverted cone for the ball or fracture plug 28 to land upon. This helps translate the load on the ball 28 from shear into compression, thereby deforming the ball 28 into the metallic, high strength composite or other rigid material seat 14 to form a seal. In some instances, the surface of such metallic, high strength composite or other rigid material seats 14 have been contoured to match the shape of the ball or fracture plug 28. One drawback of such metallic, high strength composite or other rigid material seats 14 is that high stress concentrations in the seat 14 are transmitted to the ball or fracture plug 28. For various reasons, including specific gravity and ease of milling, balls or fracture plugs 28 are often made of a composite plastic or aluminum. Also, efforts to maximize the number of zones in a well has reduced the safety margin of ball or fracture plug failure to a point where balls or fracture plugs can extrude, shear or crack under the high pressure applied to the ball or fracture plug during hydraulic fracturing operations. As noted above, when the balls 28 extrude into the metallic, high strength composite or other rigid material seat 14 they become stuck. In such instances, the back pressure from within the well below is typically insufficient to purge the ball 28 from the seat 14, which means that an expensive and time-consuming milling process must be conducted to remove the ball 28 from the seat 14.

Other prior art fracture plug seat assembly designs include mechanisms that are actuated by sliding pistons and introduce an inward pivoting mechanical support beneath the ball. These designs also have a metallic, high strength composite or other rigid material seat, but are provided with additional support from the support mechanism. These fracture plug seat assembly designs can be described as having a normally open seat that closes when a ball or fracture plug is landed upon the seat. Such normally open fracture plug seat assembly designs suffer when contaminated with the heavy presence of sand and cement. They also rely upon incrementally sized balls so such systems suffer from flow restriction and require post frac milling.

DETAILED DESCRIPTION

The method and apparatus of the present invention provides a fracture plug seat assembly used in well stimulation for engaging and creating a seal when a plug, such as a ball, is dropped into a wellbore and landed on the fracture plug seat assembly for isolating fracture zones in a well. The fracture plug seat assembly has a fracture plug seat that includes an expandable ring that enables the seat to expand when a ball passes through and actuates a counting mechanism so that balls are allowed to pass until the counting mechanism reaches a predetermined position which will enable the actuation of a locking mechanism. When actuated, the locking mechanism prevents expansion of the seat when the next ball lands on the seat and pressure is applied from the upstream direction. When flow is reversed, the seat is free to disengage from the locking mechanism and allow expansion and hence, balls that had previously passed through the seat pass through from downstream and return to the surface.

According to the fracture plug seat assembly of the present invention, all balls have the same size and, therefore, flow restriction is greatly reduced at the lower zones, since the seat orifices do not become incrementally smaller. Also, according to the fracture plug seat assembly of the present invention, when dropping balls from the surface, it is not required to drop sequential ball sizes which eliminates a potential source of errors. Moreover, only one size of seat assembly and ball must be manufactured, instead of sometimes 40 different sizes, making manufacturing more cost effective. Finally, according to the fracture plug seat assembly of the present invention, the resulting production flow from the string can eliminate the need to mill out the seats.

Figure 1:
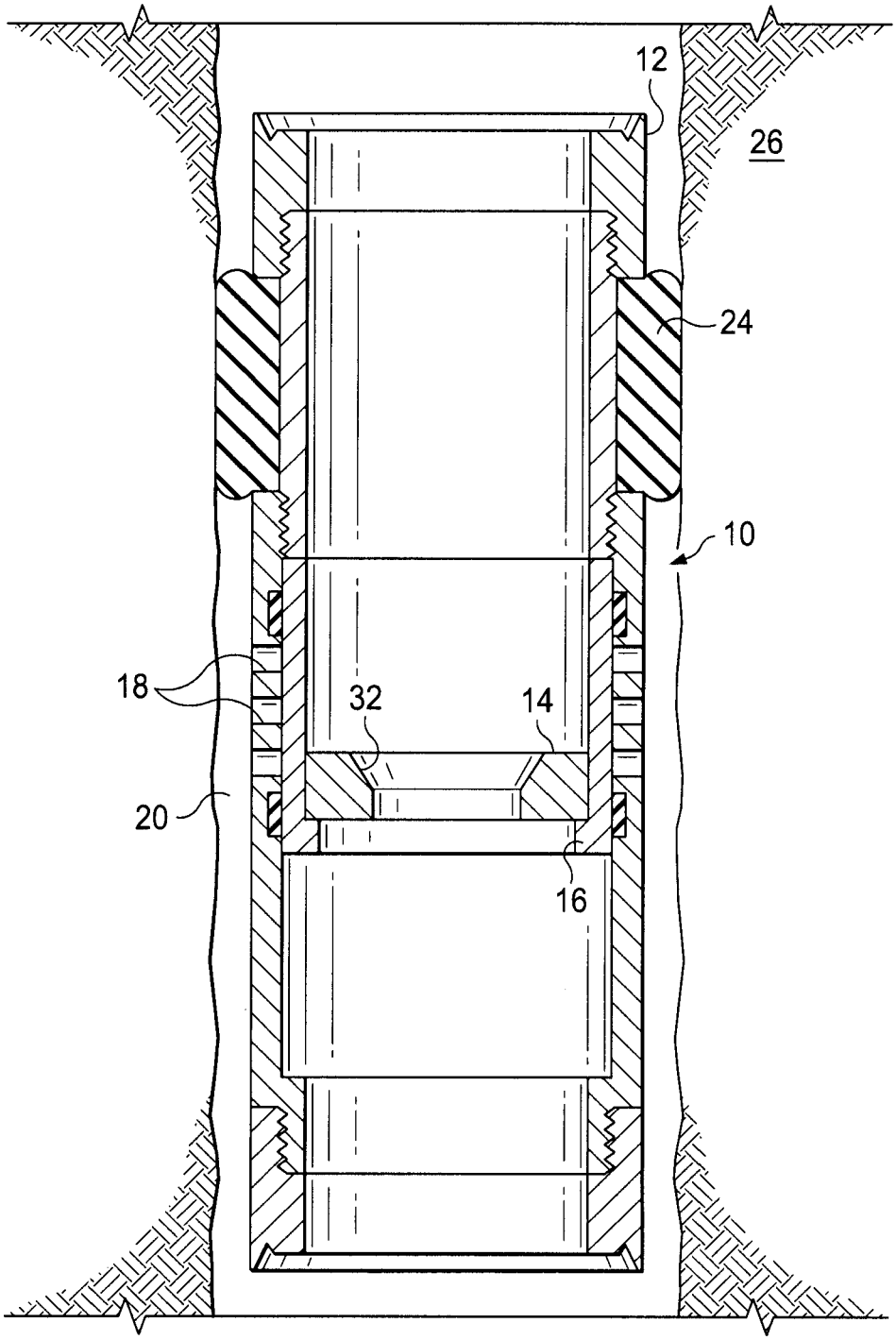
Fig. 1 (PRIOR ART)
FIG. 1 illustrates a prior art fracture plug seat assembly positioned in a well bore.
Figure 2:
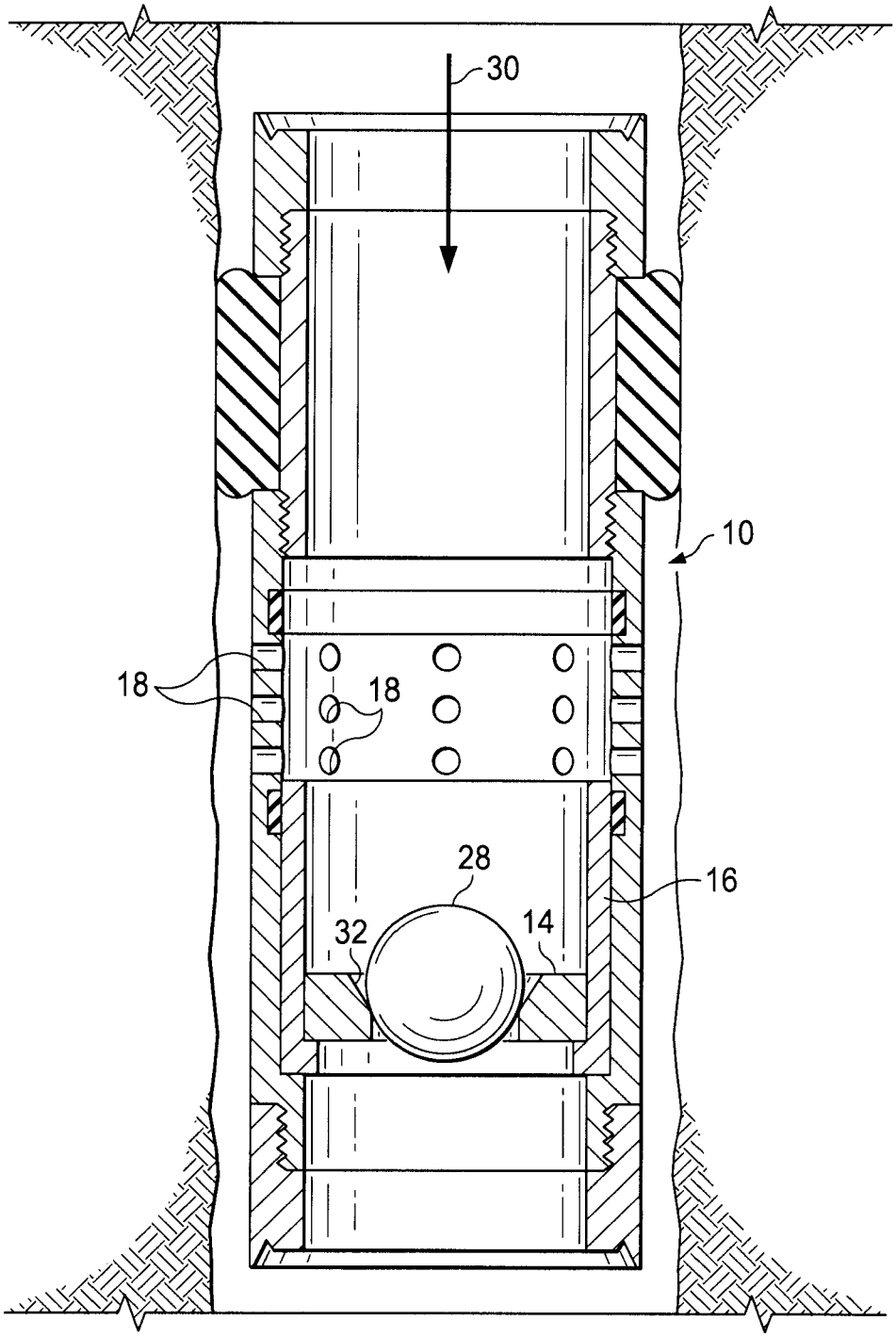
Fig. 2 (PRIOR ART)
FIG. 2 illustrates the prior art fracture plug seat assembly of FIG. 1 with a ball landed on the seat of the fracture plug seat assembly.
Figure 3:
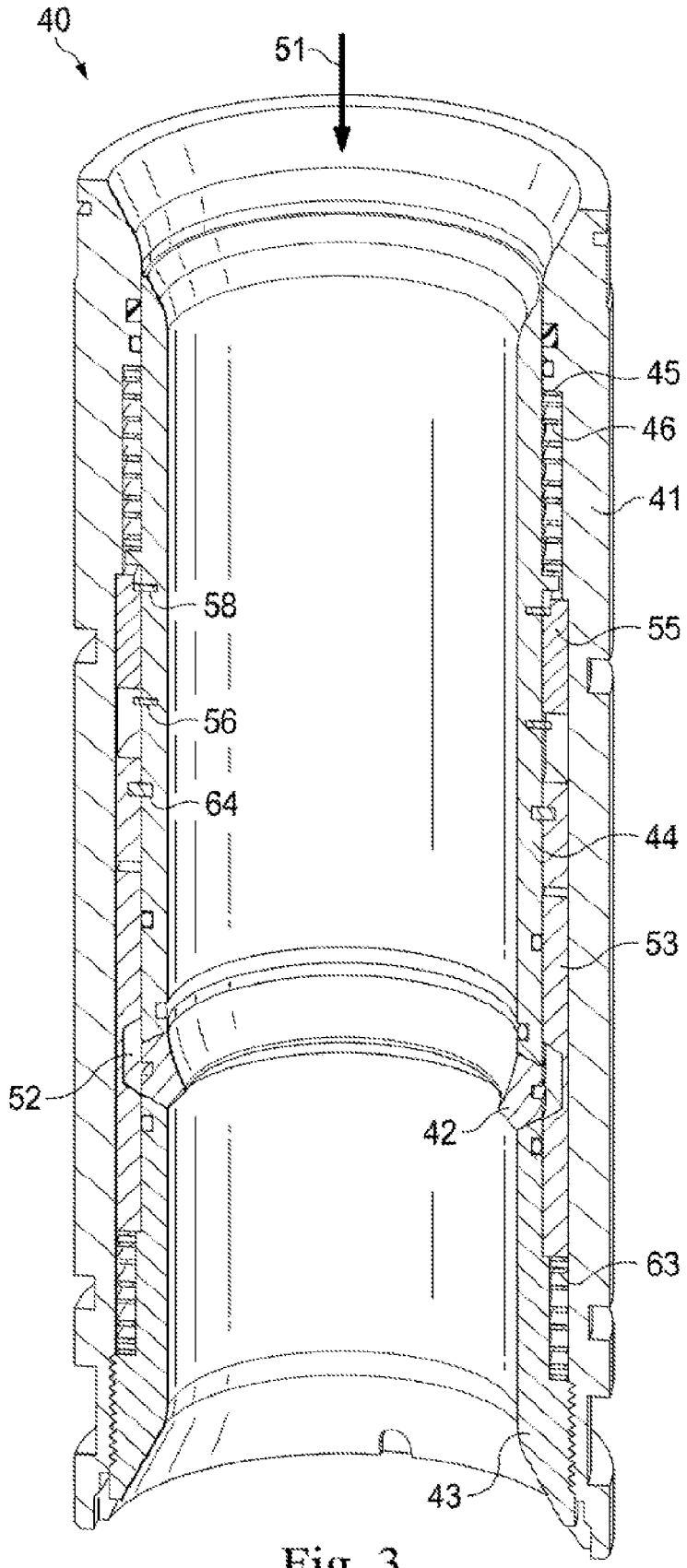
FIG. 3 illustrates a cross-section of a fracture plug seat assembly incorporating an embodiment of the present invention with a cam driven rotating counter in the unlocked position.

FIG. 3 illustrates a cross-section of a fracture plug seat assembly incorporating an embodiment of the present invention. Specifically, sliding sleeve assembly 40 is illustrated in a position to receive balls which will pass through and be counted. Sliding sleeve 41 is sealably retained within a tubing string. A segmented expandable seat assembly 42 is in a first closed position and positioned between a lower seat nut 43 and an upper piston 44. The lower seat nut 43 is threadably connected to and does not move relative to the sliding sleeve 41. The upper piston 44 is biased in the downstream direction 51 against the seat assembly 42 by a spring 46. The spring 46 engages a shoulder 45 on the sliding sleeve 41.

Figure 4:
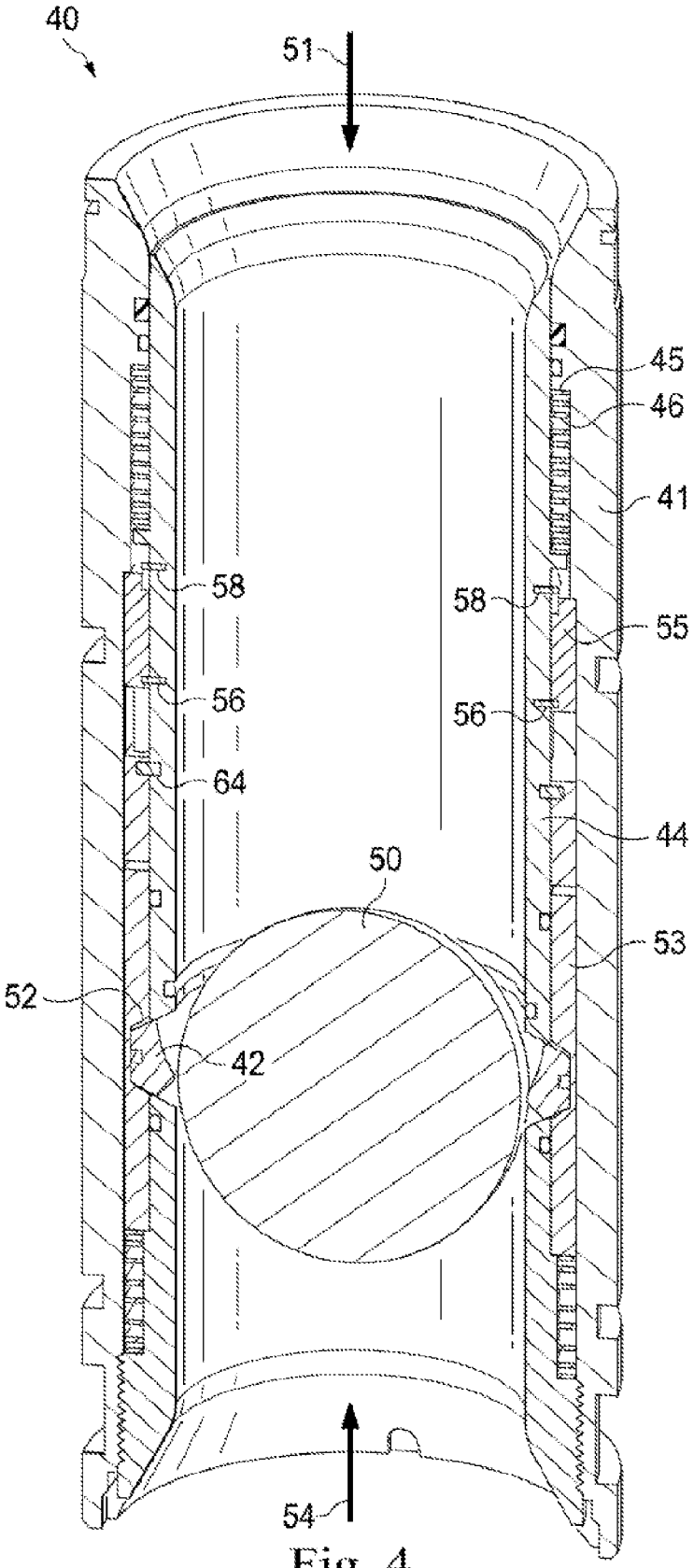
FIG. 4 illustrates a cross-section of the fracture plug seat assembly illustrated in FIG. 3 with a ball passing through the assembly and actuating an expandable seat.
Figure 5:
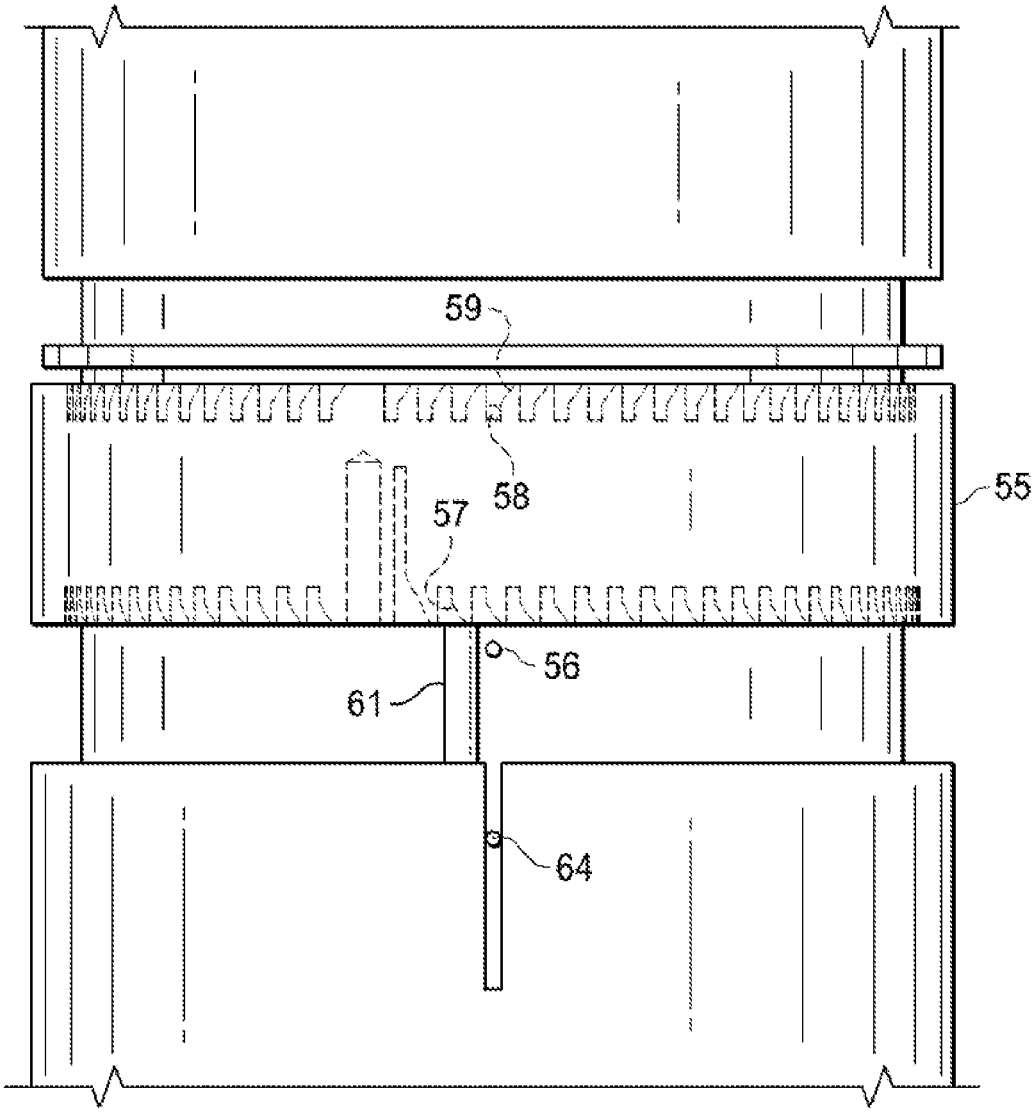
FIG. 5 illustrates a side view of an embodiment of a counting mechanism of the present invention for use in a fracture plug seat assembly with a semi-translucent counting ring.
Figure 7:
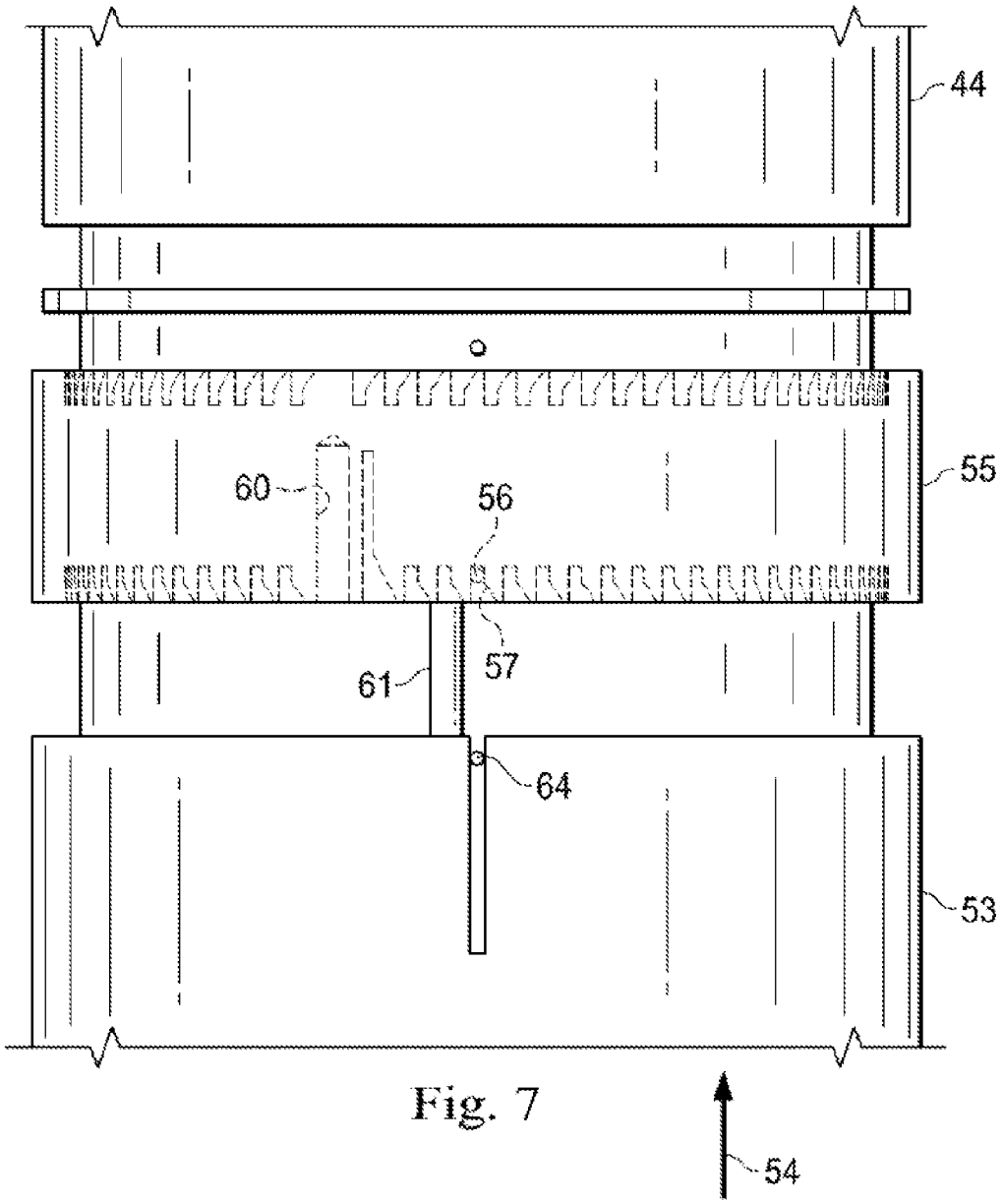
FIG. 7 illustrates a side view of the embodiment of a counting mechanism of the present invention illustrated in FIG. 5 with the components in position to actuate the counter.

FIG. 4 illustrates the fracture plug seat assembly of FIG. 3 with a ball 50 passing through the sliding sleeve assembly 40 in the direction 51 with the direction of flow moving upstream to downstream. In FIG. 4, the ball 50 is engaged with the expandable seat assembly 42 and has driven the seat radially outward into a pocket 52 of a locking ring 53. The upper piston 44 is wedged to move in the upstream direction 54 and further compresses the spring 46. When the upper piston 44 moves in the upstream direction 54 it actuates a counting ring 55 via radial pins 56 which are rigidly connected to the upper piston 44 by engaging a cam surface 57 located on the end of the counting ring 55. FIG. 5 illustrates an embodiment for actuating the counting ring 55. As the radial pins 56 move axially in the upstream direction 54 and into the counting ring 55, the counting ring 55, which is shouldered axially to the sliding sleeve 41 is forced to rotate as the radial pins 56 slide along the cam surface 57. When the ball 50 has passed through the expandable seat assembly 42, the spring 46 forces the upper piston 44 to return to the position shown in FIG. 3. According to the counting mechanism embodiment illustrated in FIG. 5, a second set of radial pins 58 engages a cam surface 59 on the upstream end of the counting ring 55 and force further rotation of the counting ring 55 by sliding across the cam surface 59. As shown in FIG. 7, axial pin(s) 61 prevent the counting ring 55 from moving in the downstream direction since they are rigidly connected to the locking ring 53 which is biased in the upstream direction 54 by spring 63 (FIG. 3).

Figure 6:
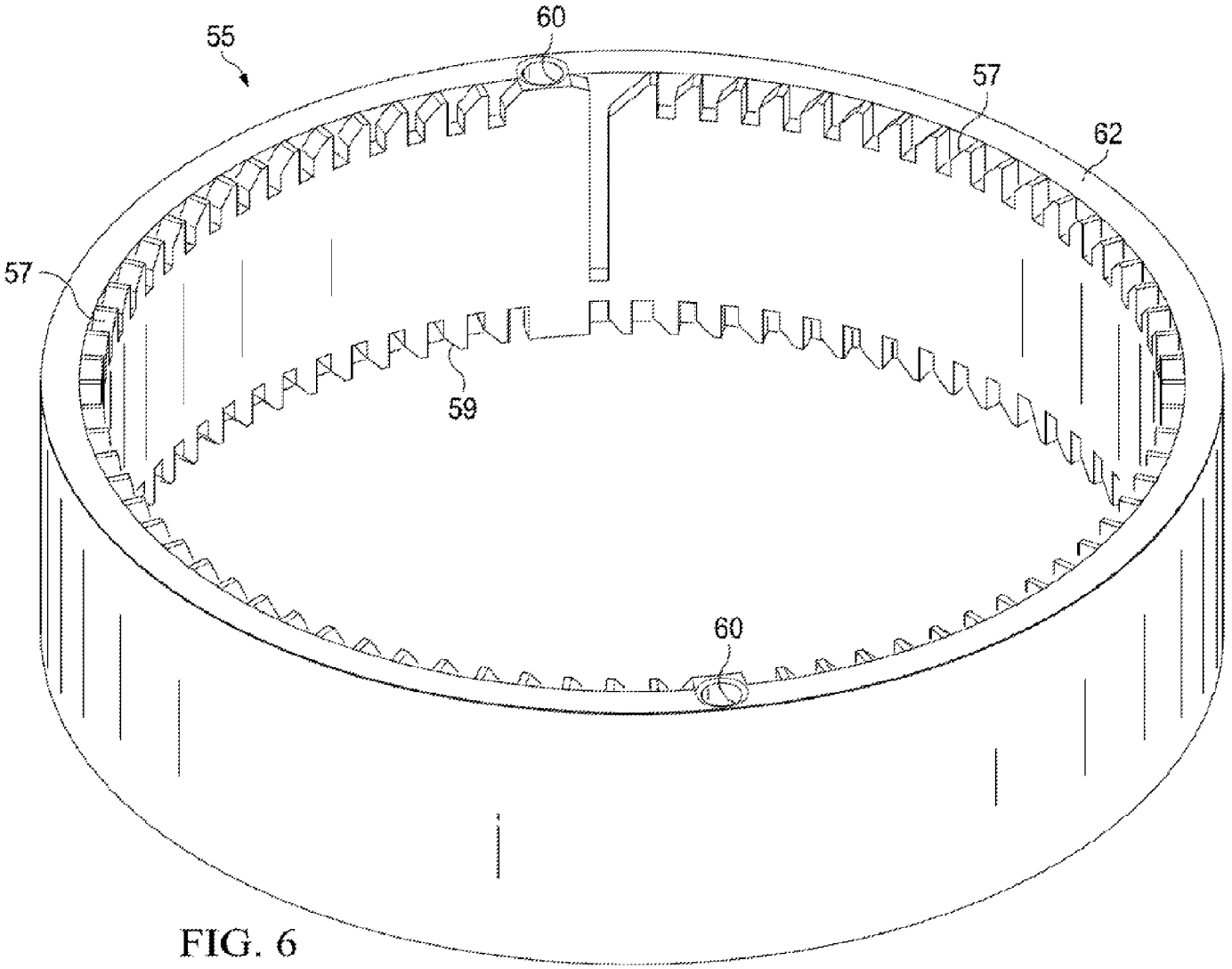
FIG. 6 illustrates an isometric view of an embodiment of a counting ring of the present invention for use in a fracture plug seat assembly.
Figure 8:
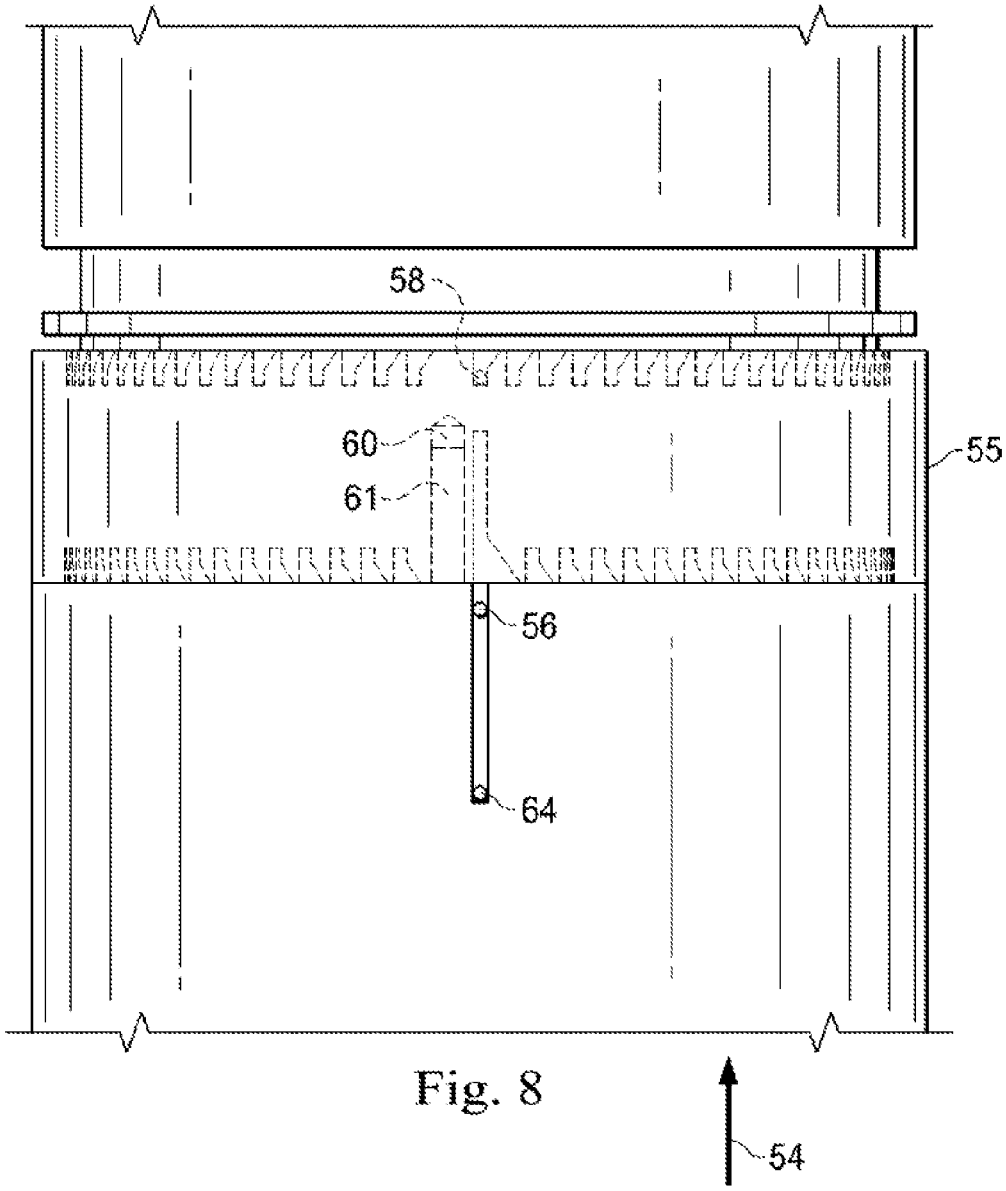
FIG. 8 illustrates a side view of the embodiment of a counting mechanism of the present invention illustrated in FIG. 5 with a locking ring in a locked position.
Figure 9:
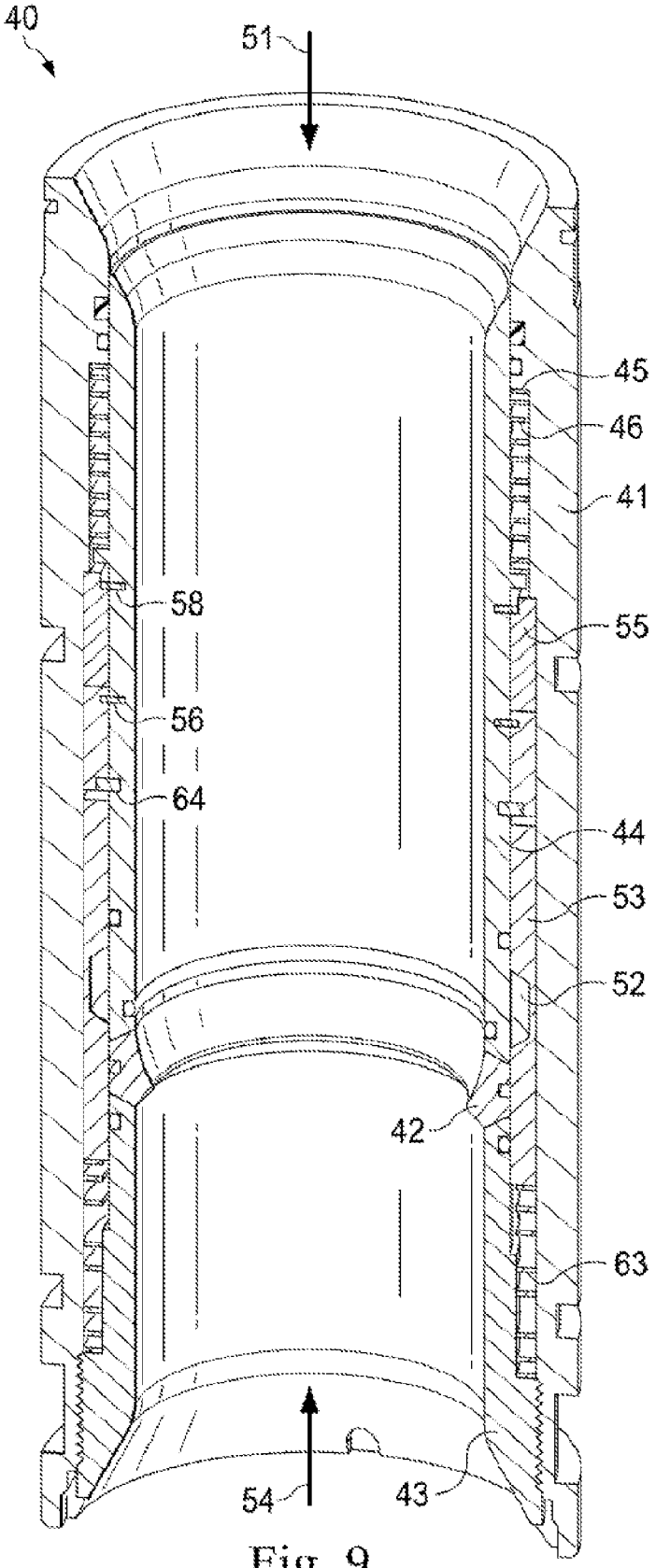
FIG. 9 illustrates a cross-section of the fracture plug seat assembly illustrated in FIG. 3 with a locking ring in a locked position.
Figure 10:
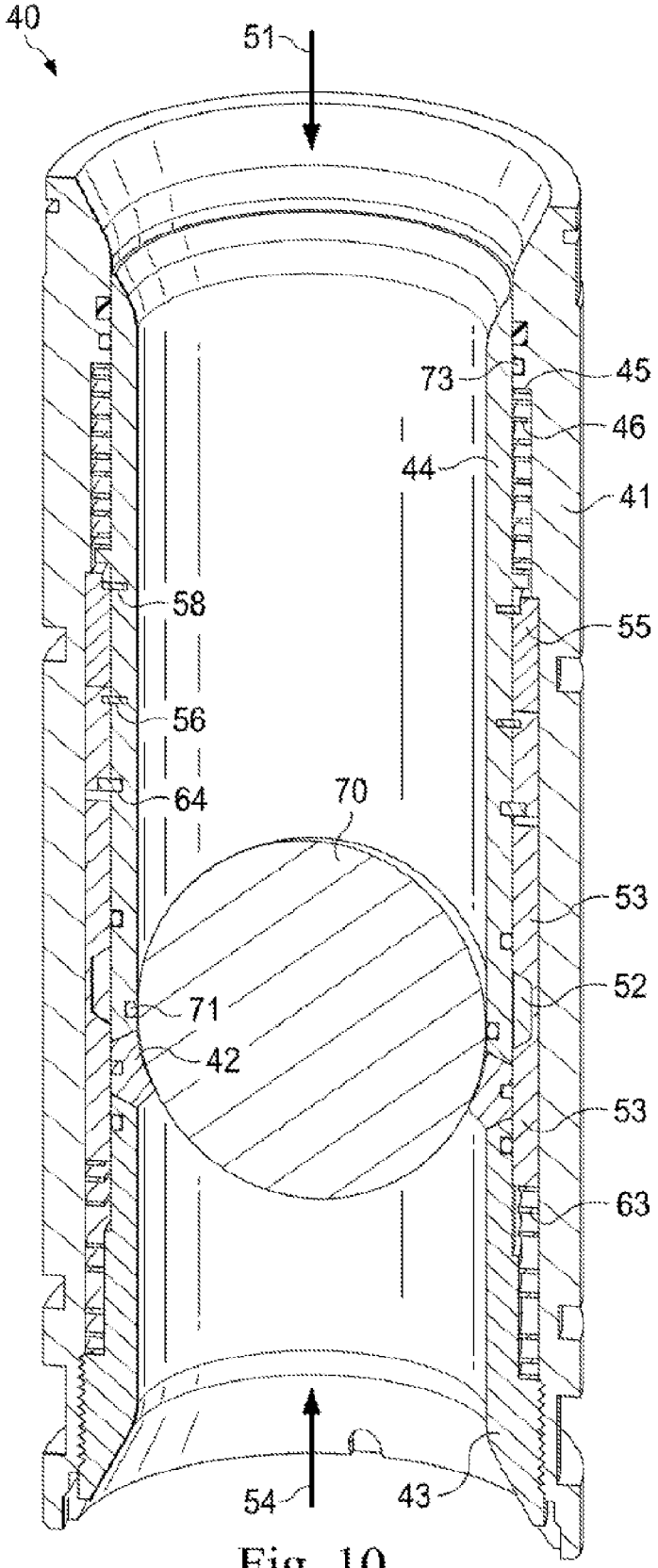
FIG. 10 illustrates a cross-section of the fracture plug seat assembly illustrated in FIG. 9 with a ball plugging the seat.

FIG. 6 illustrates an isometric view of the downstream side of counting ring 55. As depicted, counting ring 55 has two synchronized sets of cam surfaces 57, each set spanning nearly 180 degrees. Two holes 60 are located in the downstream face of the counting ring 55. As shown in FIG. 7, a partially translucent counting ring 55 is shown in a side view with a radial pin 56 engaging a cam surface 57. Also, as shown in FIG. 7, yet another radial pin 64 keeps the locking ring 53 from rotating relative to the upper piston 44. FIG. 7 is consistent with the position shown in FIG. 4. Further, as shown in FIG. 7, an axial pin 61 is fixed to the locking ring 53 and slides across the smooth surface 62 of counting ring 55 (FIG. 6). An additional axial pin is diametrically opposite the axial pin 61 and is fixed to the locking ring 53 and slides across the smooth surface 62 of counting ring 55. When a predetermined number of balls have passed through the seat assembly 42 and have thus rotated the counting ring 55 in relation to the locking ring 53, the pin(s) 61 engage hole(s) 60 and a spring 63 (FIG. 3) forces the locking ring 53 in the upstream direction 54, as shown in FIG. 8. FIG. 9 shows the sliding sleeve assembly 40 in the position where the locking ring 53 has shifted upstream and is in contact with the counting ring 55. The pocket 52 is no longer in a position to allow expansion of the expandable seat assembly 42 from a ball passing in the direction 51. FIG. 10 illustrates the sliding sleeve assembly 40 with a ball 70 that has landed on the expandable seat assembly 42 when the locking ring 53 is in the locked position. The expandable seat assembly 42 is restricted from expanding due to the locking ring 53 and hence the ball 70 cannot pass in the downstream direction 51. A seal 71 can assist in preventing fluid from passing by the ball 70 in the downstream direction 51 and a seal 73 prevents fluid from passing between the upper piston 44 and the sliding sleeve 41. Pressure applied to the ball in the downstream direction 51 results in the force necessary to actuate the sliding sleeve assembly 40 to an opened position so its corresponding zone can be fractured.

Figure 11:
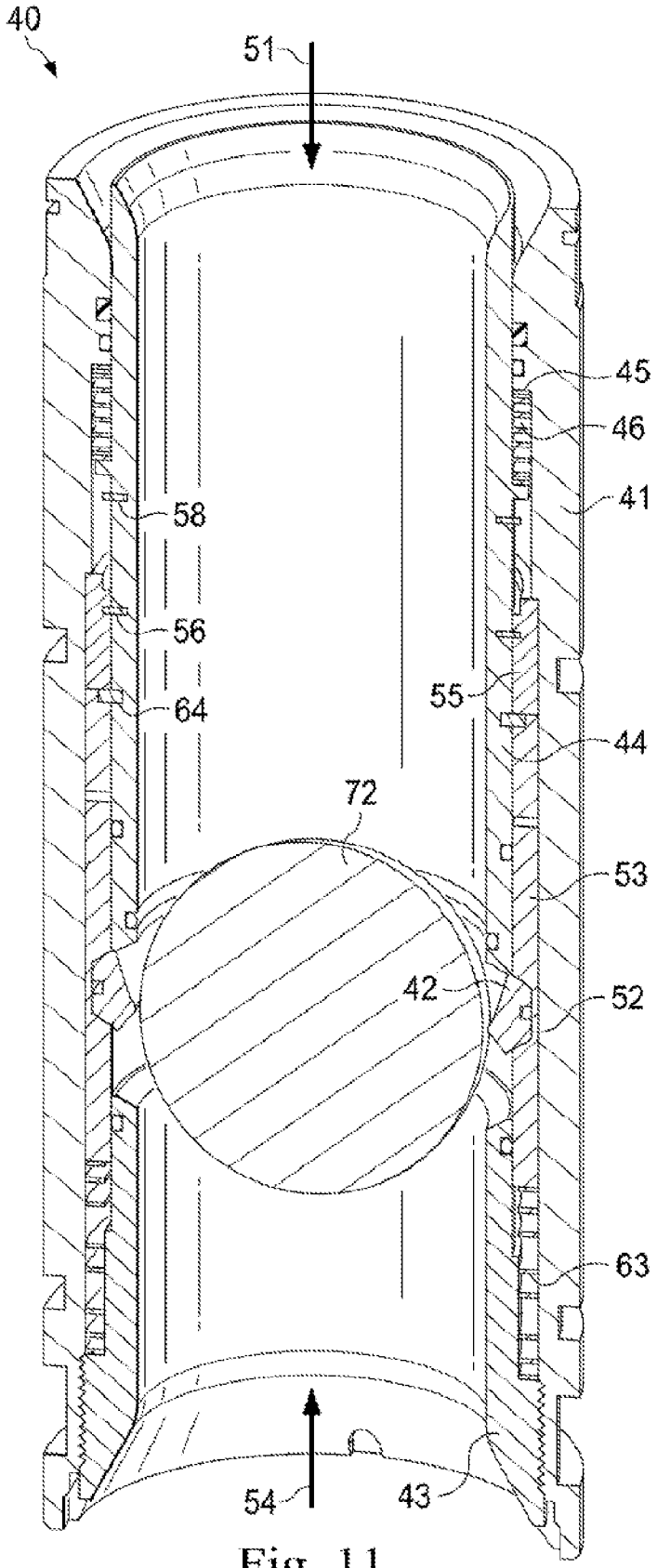
FIG. 11 illustrates a cross-section of the fracture plug seat assembly illustrated in FIG. 9 with a ball purging to the surface.

When pressure in the downstream direction is relieved, the ball 70 is purged to the surface in the direction 54 by accumulated pressure from downstream. FIG. 11 illustrates a ball 72 that had previous passed through the sliding sleeve assembly 40 in the downstream direction 51 and actuated the counting ring 55. Now pressure from the downstream side of the ball 72 forces the expandable seat assembly 42 to slide in the upstream direction 54 until it reaches the pocket 52. Ball 72 can now pass through the expandable seat assembly 40 and freely purge to the surface.

Figure 12:
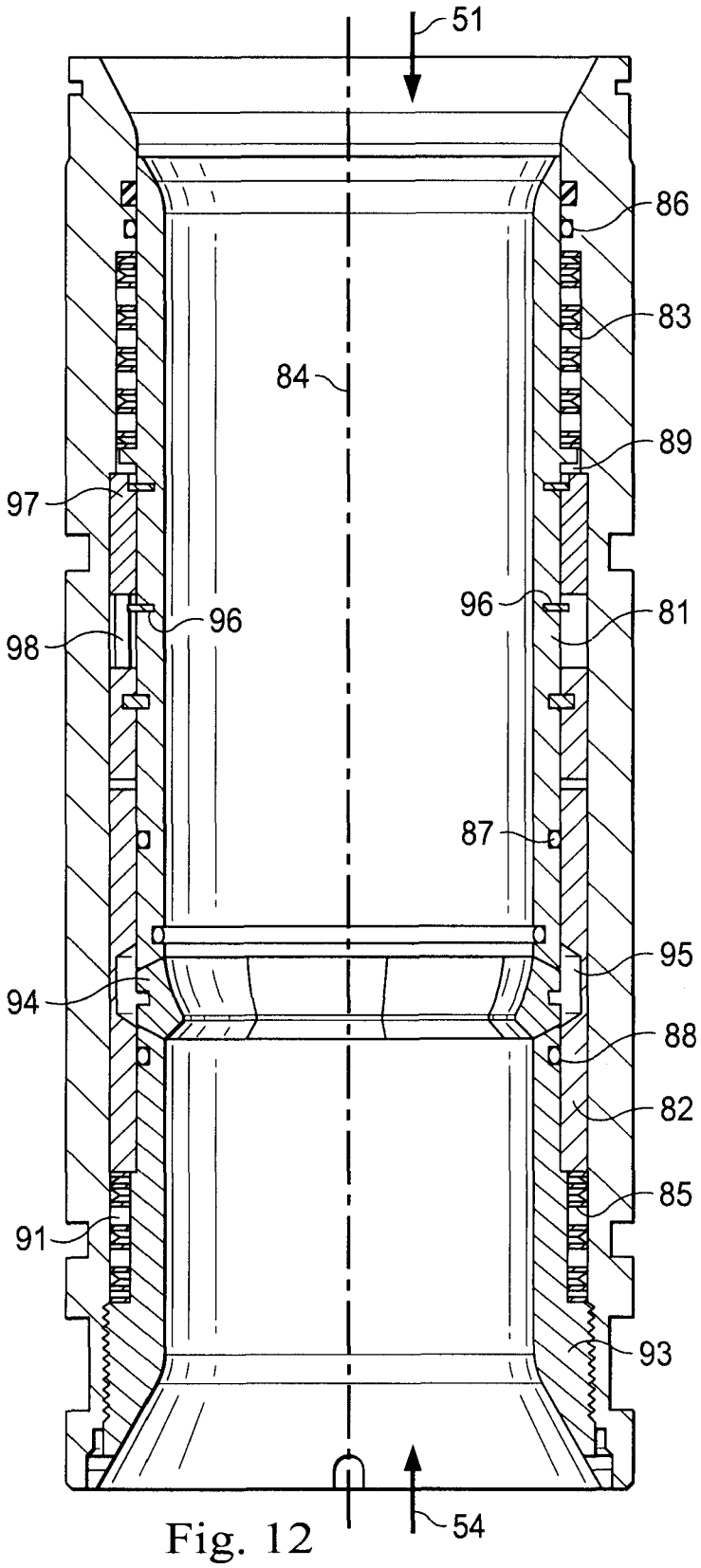
FIG. 12 is a cross-section of a fracture plug seat assembly of the present invention.

FIG. 12 is a cross-section of a fracture plug seat assembly of the present invention in a position ready to count a ball. As shown in FIG. 12, an upper wave spring 83 which helically spirals around axis 84, biases an upper piston 81 in the downstream direction 51. A wave spring 85 similar to the upper wave spring 83 biases a locking ring 82 in the upstream direction 54. An expandable seat assembly 94 is clamped by the biased upper piston 81 and a lower seat nut 93 into a cinched position. The expandable seat assembly 94 is free to expand into a pocket 95 when a ball passes through. When a ball actuates the expandable seat assembly 94, the upper piston 81 carries radial pins 96 into a cam profile of counting ring 97 to initiate rotation of the counting ring 97. After the final ball to be counted passes through the expandable seat assembly 94, an axial pin 98 falls into a mating hole in counting ring 97 and the locking ring 82 is free to be pushed in the upstream direction 54 by the wave spring 85.

Also illustrated in FIG. 12 are an upper wiper seal 86, a lower seal 87 and a nut seal 88. According to the embodiment shown in FIG. 12, both upper wiper seal 86 and lower seal 87 engage the upper piston 81 at the same diameter so there is no change in volume in annulus 89 when the upper piston 81 is actuated. While not essential to the function of this embodiment of the fracture plug seat assembly, this embodiment resists the accumulation of dirty fluid in the annulus 89. Also, the nut seal 88 guards against the incursion of debris into the space 91. Expandable seat assembly 94 may be formed from any suitable material such as a segmented ring of drillable cast iron. Those of ordinary skill in the art will understand that the expandable seat assembly 94 may also be encapsulated in rubber so as to guard against the entry of contaminants into pocket 95 and to shield the cast iron from the abrasive fluid passing through the expandable seat assembly 94.

It is to be understood that the means to actuate the counter could be a lever or radial piston that is not integrated into the expandable seat. It is convenient to use the expandable seat as the mechanism to actuate the counter. It is also to be understood that the counter could actuate a collapsible seat.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

The invention claimed is:

1. Control apparatus operably positionable in a wellbore, comprising:

a tubular member extending along an axis;

an annular seat structure coaxially supported within said tubular member and being resiliently expandable by a plug member axially passing through said seat structure, from a first diameter small enough to block passage of the plug member through said annular seat structure, to a second diameter permitting the plug member to pass through said annular seat structure, and then being permitted to return to said first diameter, the annular seat structure having a slidingly engageable surface; and a counter apparatus operative to lock said annular seat structure at said first diameter in response to a predetermined number of plug members having passed through and diametrically expanded said annular seat structure to said second diameter, said counter apparatus including a counter member rotationally drivable through a predetermined indexing angle about said axis in response to an axial force being imposed on said counter member, said counter apparatus engaged against the slidingly engageable surface in a manner such that said axial force is transmitted to said counter member from the slidingly engaged surface of said annular seat structure concurrently with said annular seat structure being expanded to said second diameter by a plug member passing therethrough.

2. The control apparatus of claim 1 wherein:

said control apparatus further comprises a sliding sleeve valve actuated by the annular seat structure upon locking in the first diameter.

3. The control apparatus of claim 1 wherein:

said annular seat structure includes a plurality of rigid circumferential segments carrying a resilient material radially biasing said annular seat structure inwardly toward said first diameter thereof.

4. The control apparatus of claim 3 wherein:

said rigid circumferential segments are of a metal material.

5. The control apparatus of claim 1 wherein said counter apparatus further includes:

a blocking member axially shiftable to block expansion of said annular seat structure to said second diameter thereof in response to said predetermined number of plug members having passed through and diametrically expanded said annular seat structure to said second diameter thereof.

6. The control apparatus of claim 5 wherein:

each of said predetermined number of plug members pass through said annular seat structure in a first axial direction, and after said blocking member has blocked expansion of said annular seat structure, said annular seat structure is axially shiftable in a second axial direction opposite to said first axial direction, relative to said blocking member to an unblocked position in which diametrical expansion of said annular seat structure is again permitted.

7. The control apparatus of claim 5 wherein:

said counter apparatus is further operative to preclude further rotational indexing of said counter member in response to axial shifting of said blocking member.

8. Control apparatus operably positionable in a wellbore, comprising:

a tubular outer member extending along an axis;

an annular seat structure coaxially supported within said tubular outer member and being diametrically expandable by a plug member passing axially therethrough, from a first diameter small enough to block passage of the plug member through said annular seat structure to a second diameter permitting the plug member to pass through said annular seat structure in a downstream direction, and then being contractible to said first diameter; and a counter apparatus operative to lock said annular seat structure at said first diameter in response to a predetermined number of plug members having passed through and diametrically expanded said annular seat structure to said second diameter, said counter apparatus, in a pre-operative orientation thereof, including:

a tubular locking member coaxially and slidably received in said tubular outer member, said tubular locking member having an annular interior side surface pocket formed therein and circumscribing said axis, a first spring structure resiliently biasing said tubular locking member in an upstream direction, a tubular counting member coaxially received in said outer tubular member in an upstream-spaced relationship with said tubular locking member, said tubular counting member being axially restrained within but rotatable relative to said tubular outer member about said axis, a tubular stop member coaxially received in said tubular locking member and fixedly anchored to said tubular outer member, a tubular piston member coaxially and slidably received in said tubular counting member and said tubular locking member in an upstream-spaced relationship with said tubular stop member, a second spring structure resiliently biasing said tubular piston member in a downstream direction toward said tubular stop member, said annular seat structure having an annular outer peripheral portion resiliently pressed between and cammingly engaged by facing end portions of said tubular stop member and said tubular piston member, and being axially aligned with but positioned radially inwardly of said tubular locking member interior side surface pocket;

first cooperatively engageable structures on said tubular locking member and said tubular counting member; and second cooperatively engageable structures on said tubular piston member and said tubular counting member, said control apparatus being configured and operative in a manner such that each of said predetermined number of plug members passing through said annular seat structure causes said peripheral portion of said annular seat structure to (1) enter and then exit said interior side surface pocket, (2) cause said tubular piston member to stroke in successive upstream and downstream directions in a manner causing said first cooperatively engageable structures to rotationally index said tubular counting member through a predetermined angle, and (3) when the last of said predetermined number of plug members has passed through said annular seat structure, permit said tubular locking member to be spring-driven in an upstream direction to move said interior side surface pocket out of receiving alignment with said peripheral portion of said annular seat structure and cause said first cooperatively engageable structures to preclude further rotation of said tubular counting member around said axis.

9. The control apparatus of claim 8 wherein:

said control apparatus is further configured and operative, subsequent to said predetermined number of plug members passing through said annular seat structure in a downstream direction, to permit said annular seat structure to be shifted by fluid pressure in an upstream direction to permit said peripheral portion of said annular seat structure to once again enter said interior side surface pocket.

10. The control apparatus of claim 8 wherein:

said control apparatus further comprises a sliding sleeve valve actuated by the annular seat structure upon locking in the first diameter.

11. In an assembly operatively positionable in a wellbore, said assembly including a tubular member extending along an axis and in which a plug seat is disposed, a method of permitting only a predetermined of plug members to expand and pass through said plug seat, said method comprising the steps of:

supporting a counter member of a counter apparatus within said tubular member for rotation about said axis;

permitting a plug member to pass through and resiliently expand said plug seat by exerting a radially outwardly directed force thereon;

transmitting an axially directed force from a slidingly engageable surface of said plug seat to said counter apparatus; and utilizing said axially directed force to rotationally index said counter member.

12. The method of claim 11 wherein said transmitting step includes the steps of:

extending a linking member of the counter apparatus between said plug seat and said counter member, and using a surface of said counter member to cammingly drive said linking member in an axial direction.

13. The method of claim 11 wherein:

said assembly further comprises a sliding sleeve valve actuated by the annular seat structure.

14. Control apparatus operably positionable in a wellbore, comprising:

a tubular member extending along an axis;

an annular seat structure coaxially supported within said tubular member and being resiliently expandable by a plug member axially passing through said seat structure, from a first diameter small enough to block passage of the plug member through said annular seat structure, to a second diameter permitting the plug member to pass through said annular seat structure, and then being permitted to return to said first diameter, the annular seat structure having a slidingly engageable surface thereon that is oblique to the axis; and a counter apparatus operative to lock said annular seat structure at said first diameter in response to a predetermined number of plug members having passed through and diametrically expanded said annular seat structure to said second diameter, said counter apparatus including a counter member rotationally drivable through a predetermined indexing angle about said axis in response to axial motion of said counter member, said counter apparatus engaged against the slidingly engageable surface in a manner such that said axial motion of said counter member is a result of said counter apparatus being engaged against the slidingly engaged surface of said annular seat structure while said annular seat structure is being expanded to said second diameter by a plug member passing therethrough.

15. The control apparatus of claim 14 wherein:

said control apparatus further comprises a sliding sleeve valve actuated by the annular seat structure upon locking in the first diameter.

16. The control apparatus of claim 14 wherein:

said annular seat structure includes a plurality of rigid circumferential segments carrying a resilient material radially biasing said annular seat structure inwardly toward said first diameter thereof.

* * * * *